US006486840B1

(12) United States Patent
Buren

(10) Patent No.: US 6,486,840 B1
(45) Date of Patent: Nov. 26, 2002

(54) DUAL FREQUENCY WINDOW MOUNT ANTENNA

(75) Inventor: Alan Van Buren, Cedar City, UT (US)

(73) Assignee: Wilson Electronics, Inc., Saint George, UT (US)

( * ) Notice: Subject to any disclaimer, the term of this patent is extended or adjusted under 35 U.S.C. 154(b) by 0 days.

(21) Appl. No.: 09/887,744

(22) Filed: Jun. 21, 2001

(51) Int. Cl.[7] ..... H01Q 1/32
(52) U.S. Cl. ..... 343/713; 343/711
(58) Field of Search ..... 343/713, 715, 343/702, 900, 859, 846, 848, 711, 712; H01Q 1/32

(56) References Cited

U.S. PATENT DOCUMENTS

| | | | | | |
|---|---|---|---|---|---|
| D297,841 | S | | 9/1988 | Shimazaki | D14/86 |
| 4,825,217 | A | * | 4/1989 | Choi | 343/715 |
| 4,839,660 | A | * | 6/1989 | Hadzoglou | 343/715 |
| 4,916,456 | A | * | 4/1990 | Shyu | 343/713 |
| 5,023,622 | A | * | 6/1991 | Blaese | 343/715 |
| 5,032,846 | A | * | 7/1991 | Chang | 343/882 |
| 5,157,410 | A | * | 10/1992 | Konishi | 343/715 |
| 5,451,966 | A | * | 9/1995 | Du et al. | 343/715 |
| 5,471,222 | A | * | 11/1995 | Du | 343/713 |
| 5,565,877 | A | * | 10/1996 | Du et al. | 343/715 |
| 6,054,961 | A | | 4/2000 | Gong et al. | 343/718 |
| 6,172,651 | B1 | * | 1/2001 | Du | 343/850 |
| 6,191,747 | B1 | | 2/2001 | Cosenza | 343/749 |
| 6,215,451 | B1 | | 4/2001 | Hadzoglou | 434/715 |
| 6,331,838 | B1 | * | 12/2001 | Scott et al. | 343/715 |

FOREIGN PATENT DOCUMENTS

EP 747990 A1 11/1996

* cited by examiner

*Primary Examiner*—Don Wong
*Assistant Examiner*—Trinh Vo Dinh
(74) *Attorney, Agent, or Firm*—Leon D. Rosen

(57) ABSTRACT

Apparatus is provided for transmitting signals between a cell phone (P), through a coaxial cable (16) through a window inner coupling (20) mounted on the inner side (I) of a window, to an outer coupling (22) on the outer side (O) of the window which connects to an antenna (24), which efficiently couples signals of both the lower cell phone frequency band of about 850 MHz and the high cell phone frequency band of about 1920 MHz that are in current use. The window coupling includes an electrically conductive inner plate (30) lying substantially facewise adjacent to the window and a conductive box device (40) lying around the inner face of the inner plate. The inner plate is of substantially rectangular shape, with a plurality of sides (111–114) extending in series around the inner plate. The length of a path (130) extending from a connection location (91) to corners (132, 134) approximately equals one-quarter wavelength of the higher cell phone frequency, while the length of a path (140) around the periphery of the plate approximately equals one-quarter wavelength of the lower cell phone frequency.

2 Claims, 3 Drawing Sheets

FIG. 1
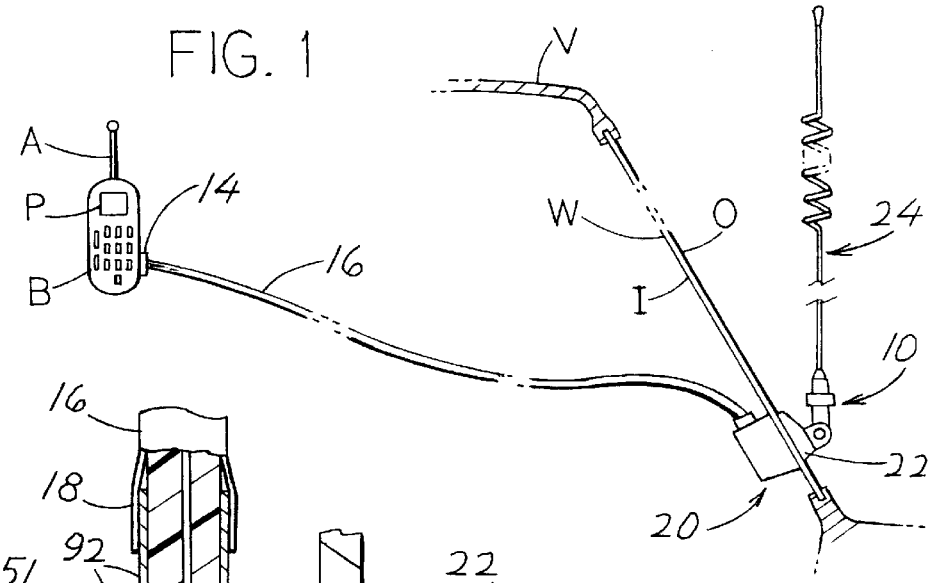
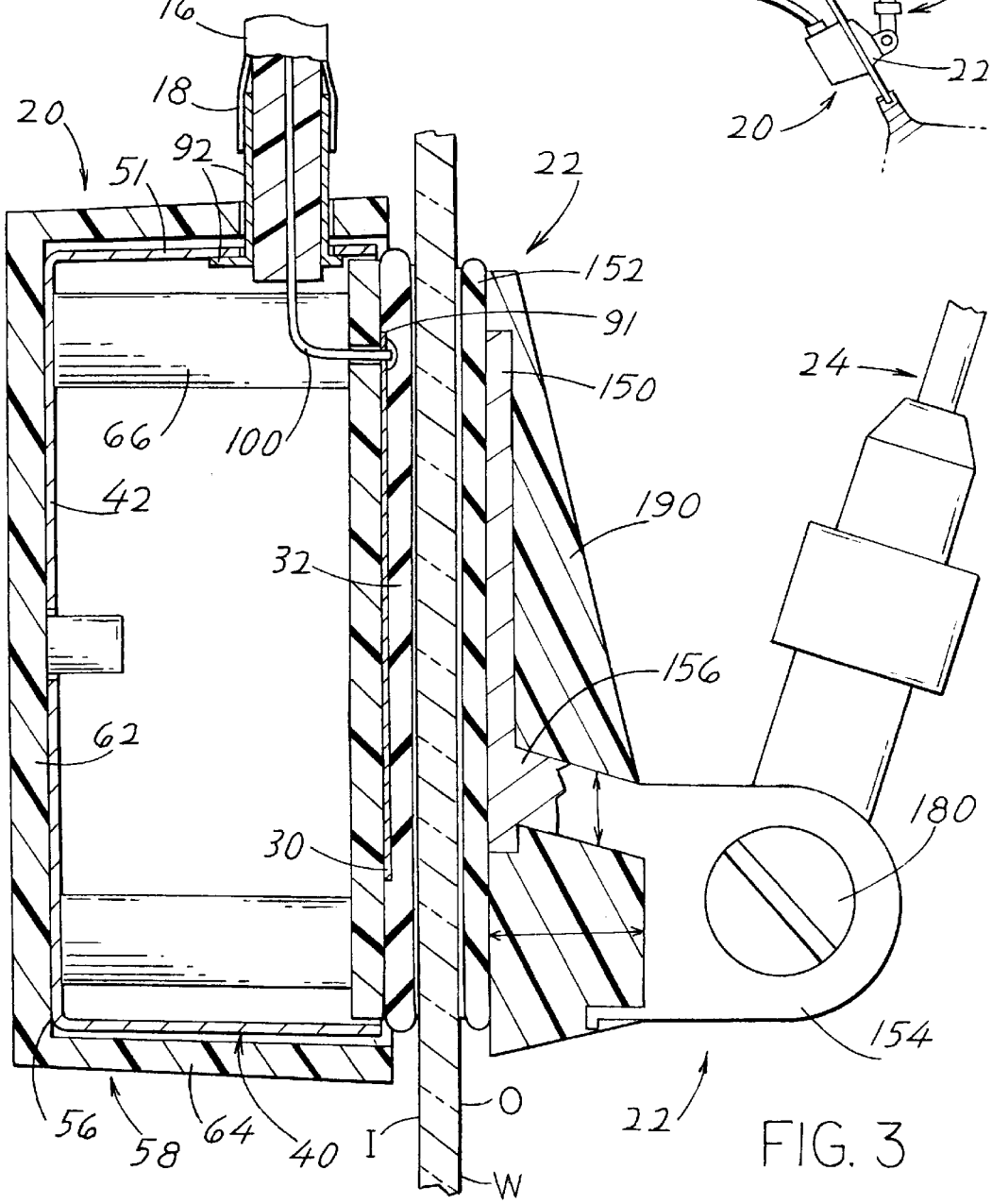
FIG. 3

DUAL FREQUENCY WINDOW MOUNT ANTENNA

BACKGROUND OF THE INVENTION

The two most commonly used frequency bands set aside for cell phone use, are the AMPS band which extends between 824 and 896 MHz, and the PCS band, which extends from 1850 to 1990 MHz. It is noted that there is also a Nextel band of 806 to 866 MHz, which primarily overlap the AMPS band. The center of the lower frequencies is about 850 MHz while the center of the higher frequencies is about 1920 MHz. Cell phones are often used in vehicles, where much of the signal is lost due to the metal vehicle body. The losses can be greatly reduced by extending a coaxial cable from a cell phone to a window mount that mounts on a window such as the rear window of an automobile, and which couples through the window to an outside antenna. The inner window coupler preferably has a resonance in the band of frequencies to be transmitted, which results in transmission of a high percentage of the signal to and from the cell phone. The window coupling must be small, as with a rectangular box of no more than about two inches on each side, to avoid blocking a substantial portion of the window that it mounts on. When mounting on a rear window with antenna and/or defrosting wires embedded therein, it is desirable that the window coupler be mounted for minimum interference.

Window couplings are available that are resonant to either the low frequency bands of about 850 MHz or to the high frequency band of about 1920 MHz. It is possible to sell two type of window couplers that are each resonant to a particular band, but cell phone users often do not know what frequency their cell phones operate on. Thus, there is a need for cell phone couplers that are resonant at both the lower frequency of about 850 MHz and the higher frequency of about 1920 MHz, so they can be used with any common cell phone. The window coupler should be of simple construction, low cost and of small size.

SUMMARY OF THE INVENTION

In accordance with one embodiment of the present invention, inner and outer window couplers are provided for transmitting signals received through a coaxial cable from an inside cell phone or other transceiver, to an outside antenna, where the window couplers are of low cost and size and can efficiently couple two widely different frequencies. The inside or inner window coupler includes an inner metal plate for lying facewise adjacent to the window and a metal box device with a bottom wall spaced from the inner plate and facing it and with side walls extending outwardly to locations surrounding the inner plate. The inner plate has a plurality of corners and a plurality of sides extending between adjacent corners. This enable a resonance for each of two widely different frequencies, each obtained by a distance around the plate from a location where the inner conductor of the coax cable is connected to one of the corners.

In one inner window coupler, a quarter wavelength for the 1920 MHz band to obtain a resonance, approximately equals the length from the location where the inner coax conductor connects to the periphery of the plate, around a first corner and to a second corner. At the same time, a quarter wavelength for resonance at the 850 MHz band approximately equals the distance around the entire periphery of the plate. This results in a dual frequency inner window coupler of minimum size.

The outer window coupler includes a one-piece metal coupler with a plate part, a post part extending away from the plate part, and a pivot mount part. The lower end of the antenna is pivotally mounted about a horizontal axis on the pivot mount part and can be clamped in any orientation.

The novel features of the invention are set forth with particularity in the appended claims. The invention will be best understood from the following description when read in conjunction with the accompanying drawings.

BRIEF DESCRIPTION OF THE DRAWINGS

FIG. 1 is a view showing apparatus of the present invention mounted on the rear window of a vehicle, and coupled through the window to an antenna, and coupled through a coax cable to a cell phone.

FIG. 3 is a partial sectional view of the inner and outer window couplers of FIG. 2.

DESCRIPTION OF THE PREFERRED EMBODIMENTS

Figures 2, 5:
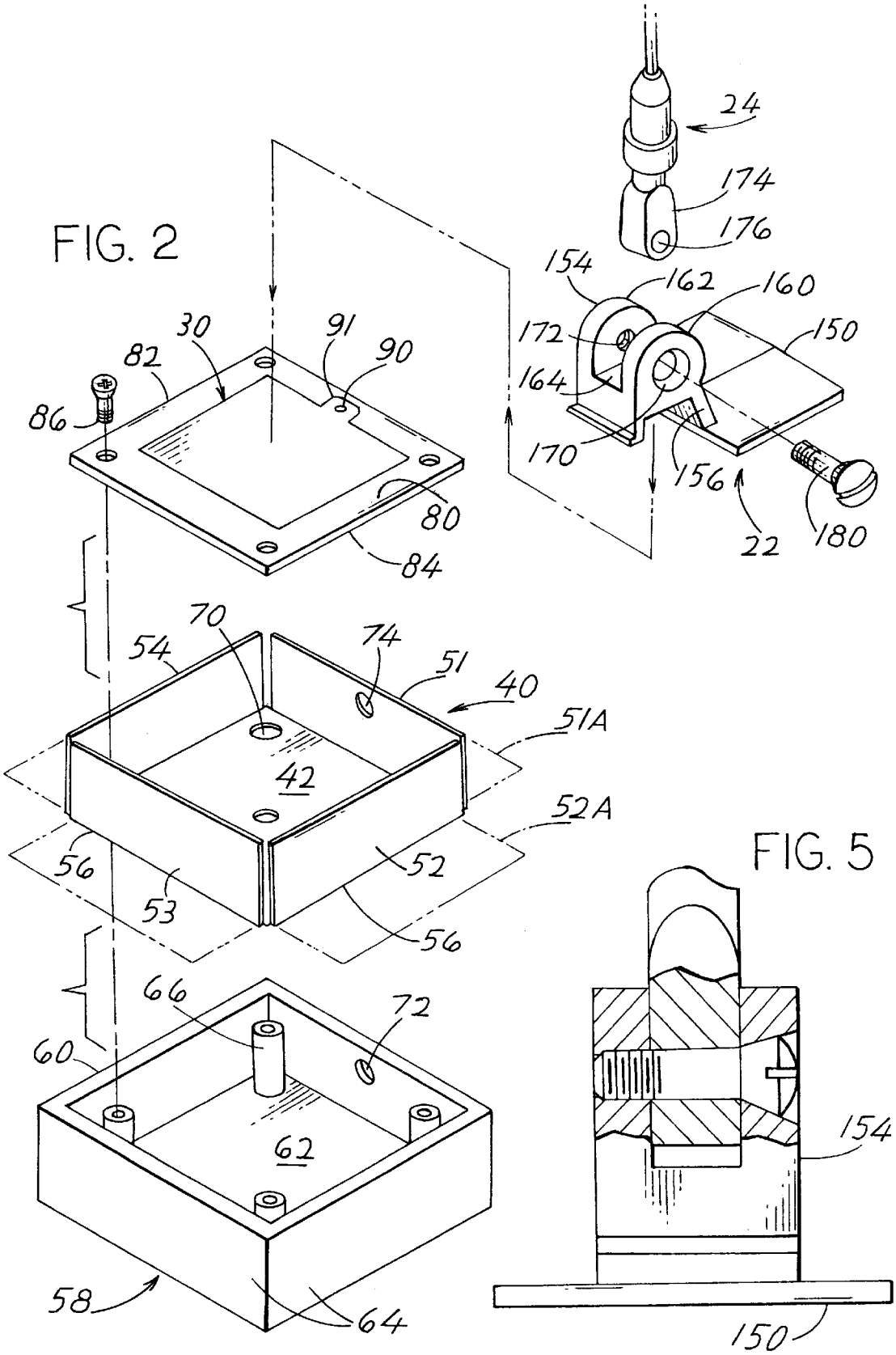
FIG. 2 is an exploded isometric view of the inner and outer window couplers of FIG. 1.
FIG. 5 is a partially sectional and end view of the outer coupler of FIG. 3.

FIG. 1 illustrates a cell phone booster system 10 which can be used by a person inside a vehicle V or other enclosure, to boost the output and input of a cell phone P. A coupler 14 attached to the cell phone and to a coaxial cable 16, is coupled to the antenna system of the cell phone, which includes the cell phone antenna A and the cell phone metal body B, or directly to the input and output that is normally connected to the antenna A. Signals passing through the coaxial cable to or from the cell phone, pass through an inner window coupler 20 that is attached to the inner side I of the window W. An outer coupler 22 is mounted at the outer side 0 of the window and connects to an outside antenna 24. The outside antenna, which has a coil resonant at multiple frequencies, experiences much less blocking from vehicle sheet metal than the cell phone antenna lying within the vehicle, so a much stronger signal can be broadcast and received.

The window coupler, shown in FIGS. 2 and 3, includes an inner conductive plate 30 which lies facewise adjacent to the inner face I (FIG. 3) of the window, with a soft plastic mount plate 32 having an adhesive surface on its outer side, being adhesively attached to the window. The soft plastic mount plate 32 takes up irregularities in the outer surface of the coupling plate 30. The coupler also includes an electrically conductive box, or metal box device 40 with a bottom wall 42 spaced inwardly from and facing the inner plate 30. The box device also has a plurality of sides 51–54 (FIG. 2) that project from the periphery 56 of the bottom wall 42 and outwardly toward the plane of the inner plate 30. The box mounts in a dielectric plastic container 58 which has a bottom wall 62 and side walls 64 that closely surround the bottom wall and side walls of the box device 40. A plurality of post 66 of the container project through holes 70 in the bottom wall of the metal box. A feed through hole 72 of the container is aligned with a feedthrough hole 74 of one side 51 of the box device.

The inner plate 30 is mounted on the outer face 80 of a circuit board 82. The inner face 84 of the circuit board mounts on top of the posts 66 of the 20 container, and is attached thereto by four screws 86. The circuit board and inner plate 30 have aligned holes at 90. The inner conductor 100 (FIG. 3) of the coaxial cable 16 extends through the aligned holes and is soldered to the inner plate 30 at a location 91. The grounded outer conductor 18 of the coaxial cable is soldered or otherwise electrically connected to the metal box 40, at the first side 51 thereof, through a short tube 92.

The metal box (40, FIG. 2) is formed from a piece of sheet metal of cruciform shape, with the initial sides such as 51A, 52A being bent 90°. The sides 51, 52 do not have to directly contact one another.

In order to obtain high gain at the two cell phone frequency bands of about 850 MHz (824 to 896 MHz for the AMPS band and 806–866 MHz for the Nextel band) and for the approximately 1920 MHz band (1850–1990 MHz) applicant constructs the inner plate 30 for resonances at about each of those frequencies. One approach would be to make the inner plate 30 in the form of a circle with the periphery of the circle equal to one-quarter wavelength of the frequency to be transmitted. However, there would not be a resonance at the other frequency which is more than twice as great.

In accordance with the present invention, applicant constructs the inner plate 30 (FIG. 4) so it has a plurality of corners, and a plurality of sides extending between adjacent corners. The particular plate 30 shown is rectangular with four sides 111, 112, 113, 114. The first side 111 has two parts extending from opposite sides of the connection location 120 which has a hole through which the inner coax conductor extends and which is soldered to the connection location 120. At a frequency of 1920 MHz, a quarter wavelength is about 1.5 inches. At a frequency of 850 MHz, a quarter wavelength is about 3.5 inches.

Figure 4:
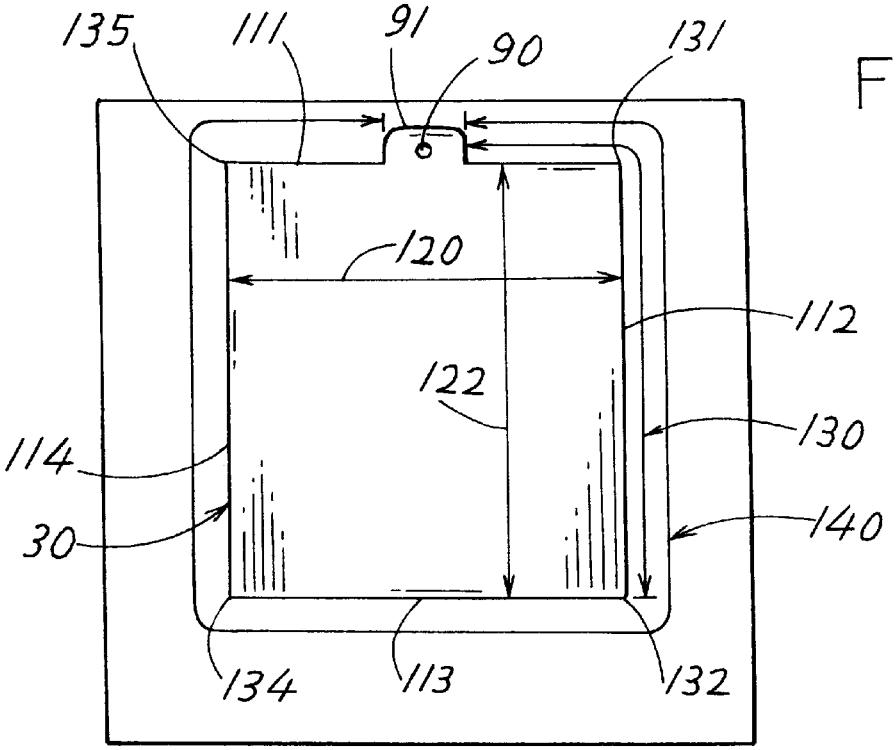
FIG. 4 is a front elevation view of the inner plate of FIG. 2.

The plate 30 of FIG. 4 is a rectangle having a width 120 of 0.963 inch and a height 122 of 1.094 inch, the connection location 91 having a width of 0.2 inch. Signal currents connected to the plate at the connection location 91, pass along the periphery of the plate. That is, applicant has found that the characteristics of the plate do not change when a large hole is placed in the center of the plate. A resonance is obtained by current passing from the connection location 91 and around the periphery to a corner, where it is reflected back. The corner is preferably "sharp", with a corner radius of curvature less that 2%, and preferably less than 1%, of the width or length of the inner plate. One path 130, extends somewhat less than halfway along the first side 111 of the plate and along the entire second side 112 of the plate to a corner 132, from which the signal is reflected. A mirror image path extends from 91 to corner 134. The length of this path 130 equals approximately 1.47 inch, which is very close to the quarter wavelength at 1920 MHz of 1.54 inch, the difference being only about 0.07 inch, or about 5%. As a result, the resonant frequency along the path 130 is close to the resonant frequency at 1920 MHz resulting in a high gain.

The distance along path 140, which extends around the periphery of the plate 30, of 3.91 inches, is somewhat greater than the quarter wavelength at 850 MHz of 3.5 inches. The difference is 12% of the quarter wavelength. This results in a resonance at the quarter wavelength of 850 MHz, but with the resonance having a relatively low Q and a consequent high VSWR (voltage standing wave ratio). However, this is sufficient to obtain a resonance and moderate gain at 850 MHz. It is also possible that there is a resonant path from one side of location 91 past corners 131, 132 and 134 to corner 135 (and in the opposite direction).

Figure 6:
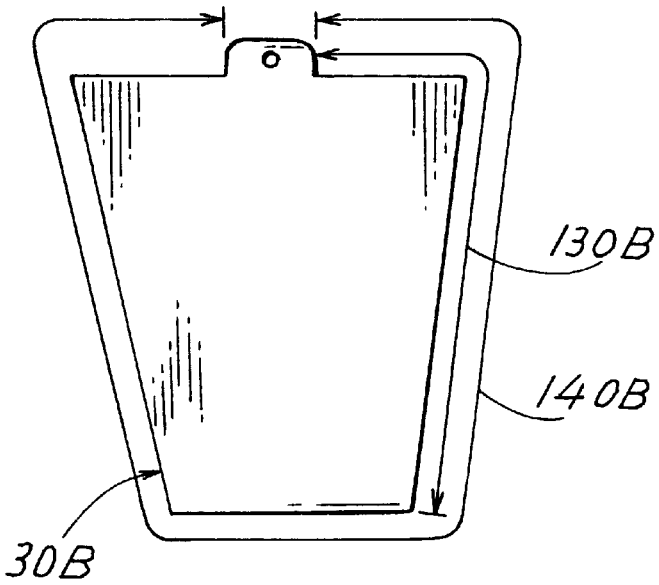
FIG. 6 is a front elevation view of an inner plate of another embodiment of the invention.

Applicant has experimented with different designs of the inner plate. One experiment, shown in FIG. 6, uses a four-sided plate 30B with two sides nonparallel, which results in the path 130B for the high frequency being the same as in FIG. 4, but with the path 140B for the lower frequency being shorter to provide very close to one-quarter wavelength paths for both 1850 MHz and 920 MHz. However, tests show that the gain at both frequencies was somewhat less than for the rectangular plate 30 of FIG. 4.

Figure 7:
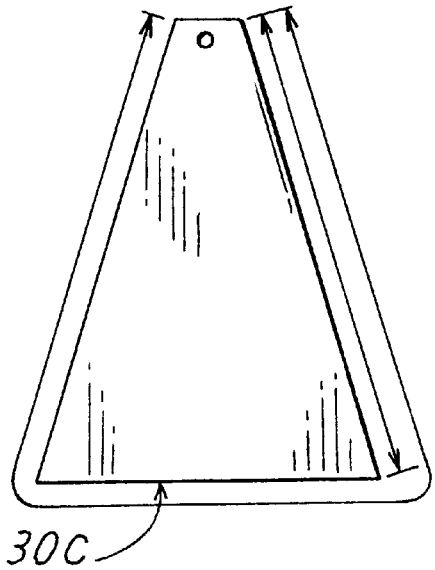
FIG. 7 is a front elevation view of an inner plate of still another embodiment of the invention.

The use of a plate with sharp corners results in the ability to obtain a plurality of different resonant frequencies that are not 2 to 1. That is, one resonant frequency can be obtained where the quarter wavelength of that frequency is the distance between the connection location for the inner conductor of a coaxial cable to one corner while another resonant frequency can be the distance from the connection location to another corner or around substantially the entire periphery of the plate. The inner plate can have three or more sides with sharp corners at the sides. FIG. 7 shows a plate 30C of largely triangular shape, which applicant also constructed and tested but which did not produce as high a gain as the rectangular plate 30 of FIG. 4. It is noted that all of the plates in FIGS. 4–7 are symmetric about a centerplane that passes through the hole 90 in the connection location 91.

Applicant's limited experimentations with plates of four sides and of largely rectangular shape, resulted in the above-described plate 30 displaying the best characteristics for the two frequencies stated. It is desirable that the path length for a resonance be within 25%, preferably within 20%, and more preferably within 15% of the quarter wavelength in vacuum, it being noted that the speed of electricity is slightly less through copper and that there are other influences on the resonant frequency including capacitive and inductive coupling to the metal box device. A distance between the connection location and one of the sharp corners of the plate is preferably no more than 20% of the wavelength in vacuum for the center frequency of the band of interest.

FIG. 3 shows that the outer coupling 22, which lies on the outer side of the window W, includes a metal plate part 150 that lies facewise adjacent to the outside of the window, with a soft plastic installment plate 152 with an adhesive surface lying against the outer face O of the window. A pivot mount 154 is formed integrally with the metal plate part 150 and is connected thereto by a plate-shaped post part 156 that extends primarily away from the plate part 150. As shown in FIG. 2, the pivot mount part 154 includes a pair of plates 160, 162 with a gap 164 between them, and with screw-receiving holes 170, 172 in the plates. The antenna 24 has a conductive lower end 174 with a through hole 176 therein. A clamping screw 180 extends through the holes, with one end of the screw screwed into the plate hole 162, to pivotally support the antenna 24 on the outer coupling 22. There is a close fit between the antenna lower end 174 and the two plates 160, 162. When the screw 180 is tightened, it fixes the pivotable orientation of the antenna and assures good electrical connection. Usually, the antenna is clamped to extend upwardly from the outer coupling 22.

FIG. 3 shows that applicant provides an overmold 190 of plastic material around the outer part of the plate portion 150 and post portion 156 to rigidize them. The metal plate part 150 had a width of 0.843 inch and length of 1.13 inch.

Thus, the invention provides a window mount antenna coupling assembly which includes inner and outer couplings that lie respectively on the inside and outside of a window. The window inner coupling includes a metal box device and an electrically conductive inner plate at the opening of the box device. The inner plate has a plurality of corners and a plurality of sides extending between adjacent corners, to define at least two resonances where current flows from a connection location to a corner or around almost the entire periphery of the plate. An outer coupling includes an outer plate device lying facewise adjacent to the window, and an integral pivot mount part with a pair of plates having holes and with the antenna lying closely between the plates and pivotally mounted thereon by a screw that can be tightened to fix the pivotal orientation of the antenna.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Apparatus for transmitting signals between a telephone lying on an inner side of a dielectric plate such as a window, and an antenna on the outer side of the dielectric plate, which is efficient at a lower cell phone band of about 850 MHz where a quarter wavelength is about 3.6 inches and that is also efficient at an upper cell phone band of about 1920 MHz where a quarter wavelength is about 1.6 inches, comprising:

a metal box device lying on said inner side of said dielectric plate, said box device having a bottom wall lying furthest from said dielectric plate and having side walls extending from a periphery of said bottom wall in an outer direction towards said dielectric plate, with a side of said box device opposite said bottom wall being open;

an inner conductive plate of electrically conductive material lying in said open side of said box device opposite said bottom wall, said inner conductive plate having an inner face facing said bottom wall but being out of electrical contact with said box, said inner conductive plate having an outer face lying facewise adjacent to an inner face of said dielectric plate;

an outer conductive plate device of conductive material that includes an outer plate part lying facewise adjacent to an outer face of said dielectric plate and connected to said antenna;

a coaxial cable which has a ground conductor connected to said box device and a signal conductor connected to said conductive inner plate;

said inner conductive plate having a plurality of corners and having a plurality of sides extending between said corners;

said conductive inner plate is of substantially rectangular shape, with a pair of first opposite sides each of a first length and a pair of second opposite sides each of a second length, and said signal conductor is connected to the middle of one of said sides;

the distance between the middle of one of said sides plus the length of an adjacent other side of said inner conductive plates, is about equal to 1.6 inches, while the circumference of said inner conductive plate is about equal to 3.6 inches.

2. Apparatus for transmitting signals between a coaxial cable that has inner and outer coax conductors and that has one cable end connected to a cell phone lying in an enclosure that has a window such as a vehicle window, and an outside plate that is connected to an antenna lying outside the enclosure, for cell phones operating in a low cell phone frequency band of about 850 MHz and cell phones operating in a high cell phone frequency band of about 1920 MHz, where the wavelengths are about 3.6 inch and 1.6 inch, respectively, comprising:

an inner electrically conductive plate for lying substantially facewise against said window;

plate-like walls forming an electrically conductive box device that includes a bottom wall that faces outwardly toward said inner plate and that is spaced inward of said inner plate;

said inner plate being of substantially rectangular shape, with first, second, third and fourth sides extending in series around said inner plate and with a connection location at a first of said sides, said coaxial cable outer conductor being connected to said box device and said cable inner conductor being connected to said connection location of said inner plate first side;

the length of half of said first side plus the length of said second side equals 1.6 inches plus or minus 20%, and the length of the sum of said first, second, third and fourth sides equals 3.6 inches plus or minus 20%.

* * * * *